US011158187B2

(12) United States Patent
Penning De Vries et al.

(10) Patent No.: US 11,158,187 B2
(45) Date of Patent: Oct. 26, 2021

(54) REMOTE-CONTROL DEVICE AND USER DEVICE USING AN IDENTIFICATION SIGNAL

(71) Applicant: KONINKLIJKE PHILIPS N.V., Eindhoven (NL)

(72) Inventors: Hendricus Theodorus Gerardus Maria Penning De Vries, Mierlo (NL); Hendrik Cornelis Kok, Tilburg (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 16/461,884

(22) PCT Filed: Nov. 17, 2017

(86) PCT No.: PCT/EP2017/079657
§ 371 (c)(1),
(2) Date: May 17, 2019

(87) PCT Pub. No.: WO2018/091681
PCT Pub. Date: May 24, 2018

(65) Prior Publication Data

US 2019/0279500 A1 Sep. 12, 2019

(30) Foreign Application Priority Data

Nov. 21, 2016 (EP) ..... 16199813

(51) Int. Cl.
*G08C 23/04* (2006.01)
*G08C 17/02* (2006.01)

(52) U.S. Cl.
CPC ..... *G08C 23/04* (2013.01); *G08C 17/02* (2013.01); *G08C 2201/50* (2013.01); *G08C 2201/71* (2013.01); *G08C 2201/92* (2013.01)

(58) Field of Classification Search
CPC .... G08C 23/04; G08C 17/02; G08C 2201/00; G08C 2201/50; G08C 2201/71;
(Continued)

(56) References Cited

U.S. PATENT DOCUMENTS 6,424,285 B1 7/2002 Perdue et al.
6,570,524 B1 5/2003 Mullaly et al.
2012/0153838 A1* 6/2012 Schenk ..... H05B 47/19 315/151

FOREIGN PATENT DOCUMENTS

WO 2004047011 A2 6/2004
WO 2016050708 A1 4/2016
WO WO-2016050708 A1 * 4/2016 ..... G06F 3/0304

OTHER PUBLICATIONS

International Search Report and Written Opinion, International Application No. PCT/EP2017/079657, dated Feb. 6, 2018.

* cited by examiner

*Primary Examiner* — Franklin D Balseca

(57) ABSTRACT

The invention is directed at a remote-control device for controlling one or more user devices, comprising a directional optical sensor for receiving one or more optical signals from the user devices. Each optical signal encodes a device identifier by high and low signal states in periods having granulated lengths. Each granulated length is an integer number of clock periods of a transmitter clock. The transmitter clock has a clock ratio to the predetermined receiver clock, the clock ratio being a number larger than one. At least one granulated length is longer than an integer number of clock periods of the predetermined receiver clock by a fraction of the clock period of the predetermined receiver clock, which granulated length may be detected by an asynchronous receiver clock and a detection range having only two values.

13 Claims, 9 Drawing Sheets

(58) Field of Classification Search
CPC ..... G08C 2201/91; G08C 2201/92; H04N 5/4403; H04N 21/42226
See application file for complete search history.

| | |
|---|---|
| Camera frame rate | 120 Hz |
| Payload length | 8 bits |
| Blob tracker threshold | 100 pixels |
| Beacon clock jitter | 0.1 ms pk |
| Target clock tolerance | 3.0 % |
| Minimum decoder length | 1 clks |
| Violation zone | 0 clks |
| TxClk/RxClk ratio | 2.0 |

| | | | | | |
|---|---|---|---|---|---|
| b00 | 1 | 1.5 | 2 | 0.738 | 1.258 |
| b01 | 3 | 3.5 | 4 | 0.888 | 1.111 |
| b02 | 5 | 5.5 | 6 | 0.929 | 1.071 |
| b03 | 7 | 7.5 | 8 | 0.948 | 1.052 |
| b04 | 9 | 9.5 | 10 | 0.959 | 1.041 |

| | | | | | |
|---|---|---|---|---|---|
| Duration | Min | 23.0 | Avg 35.0 | Max | 47.0 clks |
| Duration | Min | 0.2 | Avg 0.3 | Max | 0.4 s |

| | |
|---|---|
| Relative pointer speed limit | 0.333 |
| Overall system clock tolerance | 4.104 % |

%

FIG. 3

| | |
|---|---|
| Camera frame rate | 120 Hz |
| Payload length | 8 bits |
| Blob tracker threshold | 100 pixels |
| Beacon clock jitter | 0.1 ms pk |
| Target clock tolerance | 6.0 % |
| Minimum decoder length | 1 clks |
| Violation zone | 0 clks |
| TxClk/RxClk ratio | 2.0 |

| | | | | | |
|---|---|---|---|---|---|
| b00 | 1 | 1.5 | 2 | 0.738 | 1.258 |
| b01 | 3 | 3.5 | 4 | 0.888 | 1.111 |
| b02 | 5 | 5.5 | 6 | 0.929 | 1.071 |
| b03 | 7 | 8.0 | 9 | 0.889 | 1.111 |
| b04 | 10 | 11.0 | 12 | 0.919 | 1.081 |

Duration Min 24.500 Avg 37.000 Max 50.500 clks
Duration Min 0.204 Avg 0.308 Max 0.421 s Relative pointer speed limit 0.333
Overall system clock tolerance 7.082 %
%

FIG. 6

| | |
|---|---|
| Camera frame rate | 120 Hz |
| Payload length | 8 bits |
| Blob tracker threshold | 100 pixels |
| Beacon clock jitter | 0.1 ms pk |
| Target clock tolerance | 4.0 % |
| Minimum decoder length | 1 clks |
| Violation zone | 1 clks |
| TxClk/RxClk ratio | 2.0 |

| | | | | | |
|---|---|---|---|---|---|
| b00 | 1 | 1.5 | 2 | 0.738 | 1.258 |
| b01 | 4 | 4.5 | 5 | 0.913 | 1.087 |
| b02 | 7 | 7.5 | 8 | 0.948 | 1.052 |
| b03 | 10 | 11.0 | 12 | 0.919 | 1.081 |
| b04 | 14 | 15.0 | 16 | 0.941 | 1.059 |

Duration Min 28.500 Avg 47.000 Max 66.500 clks
Duration Min 0.237 Avg 0.392 Max 0.554 s Relative pointer speed limit 0.333
Overall system clock tolerance 5.196 %
%

FIG. 7

| | |
|---|---|
| Camera frame rate | 120 Hz |
| Payload length | 8 bits |
| Blob tracker threshold | 100 pixels |
| Beacon clock jitter | 0.1 ms pk |
| Target clock tolerance | 6.0 % |
| Minimum decoder length | 1 clks |
| Violation zone | 1 clks |
| TxClk/RxClk ratio | 2.0 |

| | | | | | |
|---|---|---|---|---|---|
| b00 | 1 | 1.5 | 2 | 0.738 | 1.258 |
| b01 | 4 | 4.5 | 5 | 0.913 | 1.087 |
| b02 | 7 | 8.0 | 9 | 0.889 | 1.111 |
| b03 | 11 | 12.0 | 13 | 0.926 | 1.074 |
| b04 | 15 | 16.5 | 18 | 0.916 | 1.084 |

| | | | | | |
|---|---|---|---|---|---|
| Duration | Min | 30.0 | Avg 50.0 | Max | 72.0 clks |
| Duration | Min | 0.3 | Avg 0.4 | Max | 0.6 s |

| | |
|---|---|
| Relative pointer speed limit | 0.333 |
| Overall system clock tolerance | 7.412 % |

FIG. 8

REMOTE-CONTROL DEVICE AND USER DEVICE USING AN IDENTIFICATION SIGNAL

CROSS-REFERENCE TO PRIOR APPLICATIONS

This application is the U.S. National Phase application under 35 U.S.C. § 371 of International Application No. PCT/EP2017/079657, filed on 17 Nov. 2017, which claims the benefit of European Patent Application No. 16199813.3, filed on 21 Nov. 2016. These applications are hereby incorporated by reference herein.

FIELD OF THE INVENTION

The present invention is directed at a remote-control device for controlling one or more user devices, comprising a directional optical sensor for receiving one or more optical signals from the user devices. The invention is further directed at a user device arranged for being operated by means of a remote-control device as described, wherein the user device comprises an optical transmitter for transmitting an optical signal, and a modulator cooperating with the optical transmitter for modulating the optical signal. The invention is further directed at a method of analyzing optical signals for identification of one or more user devices, a method of composing an optical signal for identification in a user device, and computer program products for performing such methods. Moreover, the invention relates to an optical identification signal.

BACKGROUND

In most living rooms, multiple user devices may be present that can be controlled with a remote-control from a distance. Traditionally, such devices include televisions, audio systems and DVD or Blu-ray players, but the number of remotely controllable devices is steadily growing. For example, there can be lamps allowing to remotely set color or dimming levels. Another example is an air control system where the air flow or temperature may be controlled.

A known problem is that the number of different remote-control devices in a traditional setup corresponds with the number of remotely controllable devices present in the room, i.e. each device has its own remote-controller. To users this is experienced as a nuisance, e.g. having to find the correct remote-controller or requiring to understand all the functions that are available for control. Already for quite some years, this has led to the integration of control functions for various devices into one controller, and the development of universal controllers that can be programmed to be associated with various devices. With the wide spreading and development of smart phones and tablets, such functions may nowadays be controlled via applications with dedicated menus.

The above developments, however, do not completely resolve the problem. Most remote-controllers or apps are still only suitable for controlling certain types of devices, e.g. only lighting or only multimedia devices. Moreover, the existing solutions do not provide a solution in the case a multitude of devices (e.g. lamps) of the same type is to be controlled. The control application needs to know the address of the lamp that needs to be controlled. The user may try to remember device addresses, but that gets difficult when the number of devices grows and evidently this is not the most user-friendly solution.

Some remote-controllers are nowadays proposed that allow selection of a to-be-controlled user device by means of pointing to the device. An example of such a remote-controller device is described in International patent application WO 2016/050708. This document describes user devices transmitting an optical identification signal having high and low signal states constituting signal fragments according to a code. The code defines a signal pattern of signal fragments, the signal pattern uniquely identifying a user device. Each signal fragment consists of a low signal state during a low period and a high signal state during a high period, the low and high periods having predetermined lengths expressed in channel bits of a channel symbol to encode different signal fragment types.

SUMMARY OF THE INVENTION

In the known code, to accommodate proper detection at a relatively slow receiver clock rate, the low signal states corresponding to one channel bit have minimum duration, e.g. three times a predetermined receiver clock rate. As a result, the known optical identification signal code is not efficient in that it requires a relative long time to transmit the signal pattern.

An object of the present invention it is to provide a remote-control device and remote-control system for controlling user devices with increased performance in terms of optical identification signal code efficiency.

To this end, there is provided herewith a remote-control device for controlling one or more user devices, comprising input means for receiving input from a user, a transmitter for transmitting control commands to said one or more user devices for control thereof, a directional optical sensor for receiving one or more optical signals from the user devices, and a processor, for identification of at least one of said user devices, arranged to analyze at least one of said received signals for associating thereof with at least one of said user devices, the one or more optical signals having high and low signal states constituting signal parts to be sampled at a predetermined receiver clock, and each optical signal comprising a signal pattern of signal parts, the signal pattern uniquely identifying one of said user devices;

each signal part comprising at least one low signal state during a low period and at least one high signal state during a high period, the low and high periods having granulated lengths, different granulated lengths determining different signal part types;

each granulated length being an integer number of clock periods of a transmitter clock, the transmitter clock having a clock ratio to the predetermined receiver clock, the clock ratio being a number larger than one, and at least one granulated length being longer than an integer number of clock periods of the predetermined receiver clock by a fraction of the clock period of the predetermined receiver clock;

the processor being further arranged, for said associating, to decode the signal parts based on detecting the granulated lengths and associating each signal part with its signal part type for obtaining therefrom the signal pattern.

There is also provided a user device arranged for being operated by means of a remote-control device in accordance with any of the previous claims, the user device comprising a receiver for receiving control commands from said remote-control device for control of said user device, an optical transmitter for transmitting an optical signal, a modulator cooperating with the optical transmitter for modulating the optical signal to have high and low signal states constituting signal parts to be sampled at a predetermined receiver clock, and a controller cooperating with the modulator for enabling modulation of the optical signal in accordance with a signal pattern consisting of the signal parts, the signal pattern uniquely identifying the user device;

each signal part comprising at least one low signal state during a low period and at least one high signal state during a high period, the low and high periods having granulated lengths, different granulated lengths determining different signal part types;

each granulated length being an integer number of clock periods of a transmitter clock, the transmitter clock having a clock ratio to the predetermined receiver clock, the clock ratio being a number larger than one, and at least one granulated length being longer than an integer number of clock periods of the predetermined receiver clock by a fraction of the clock period of the predetermined receiver clock.

There is also provided a method of analyzing optical signals for identification of one or more user devices, in a remote-control device, the remote-control device comprising a directional optical sensor for receiving one or more optical signals from the user devices and for detecting an incoming direction of said received optical signals, the method comprising:

receiving, using the directional optical sensor, one or more optical signals from the user devices and detecting an incoming direction of said received optical signals;

analyzing at least one of said received signals for associating thereof with at least one of said user devices, the one or more optical signals having high and low signal states constituting signal parts to be sampled at a predetermined receiver clock, and each optical signal comprising a signal pattern of signal parts, the signal pattern uniquely identifying one of said user devices;

each signal part comprising at least one low signal state during a low period and at least one high signal state during a high period, the low and high periods having granulated lengths, different granulated lengths determining different signal part types;

each granulated length being an integer number of clock periods of a transmitter clock, the transmitter clock having a clock ratio to the predetermined receiver clock, the clock ratio being a number larger than one, and at least one granulated length being longer than an integer number of clock periods of the predetermined receiver clock by a fraction of the clock period of the predetermined receiver clock;

the method further comprising, for said associating, recognizing the signal parts based on the granulated lengths and associating each signal part with its signal part type for obtaining therefrom the signal pattern.

There is also provided a method of composing an optical signal for identification of a user device comprising an optical transmitter and a modulator cooperating with the optical transmitter, wherein the method comprises:

providing a data signal to the modulator for enabling modulation of the optical signal in accordance with a signal pattern of signal parts, the signal pattern uniquely identifying the user device;

modulating, using the modulator, the optical signal to have high and low signal states constituting the signal parts to be sampled at a predetermined receiver clock, each signal part comprising at least one low signal state during a low period and at least one high signal state during a high period, the low and high periods having granulated lengths, different granulated lengths determining different signal part types;

each granulated length being an integer number of clock periods of a transmitter clock, the transmitter clock having a clock ratio to the predetermined receiver clock, the clock ratio being a number larger than one, and at least one granulated length being longer than an integer number of clock periods of the predetermined receiver clock by a fraction of the clock period of the predetermined receiver clock.

There is also provided a transitory or non-transitory computer-readable medium comprising a computer program, the computer program comprising instructions for causing a processor system to perform any of the above methods of analyzing or composing an optical signal.

There is also provided an optical identification signal, the optical identification signal having high and low signal states constituting signal parts to be sampled at a predetermined receiver clock, and comprising a signal pattern of signal parts, the signal pattern uniquely identifying a user device;

each signal part comprising at least one low signal state during a low period and at least one high signal state during a high period, the low and high periods having granulated lengths, different granulated lengths determining different signal part types;

each granulated length being an integer number of clock periods of a transmitter clock, the transmitter clock having a clock ratio to the predetermined receiver clock, the clock ratio being a number larger than one, and at least one granulated length being longer than an integer number of clock periods of the predetermined receiver clock by a fraction of the clock period of the predetermined receiver clock.

The remote-control device applies a directional optical sensor for receiving optical signals transmitted by user devices with which the remote-control device has a direct line of sight.

Having found an optical signal, the processor in the remote-control device is arranged for associating the at least one received optical signal with the at least one of said user devices. To do so, the processor has to keep track of the optical signal during a time at least covering the transmission time of the signal pattern to enable analysis thereof for identification of an associated user device. Keeping track may involve compensating for unintentional movements of the hand of the user pointing the remote-control device, e.g. using a movement sensor or image processing of subsequent camera images.

The user devices may include all kinds of devices, such as lamps, a heating system, a thermostat, a radio, a media player, a television, etc. The invention may be implemented in any device that allows to be remotely controlled by a remote-controller. It is also possible that a user device is connected to an intermediate control unit which comprises the optical transmitter, modulator and controller as described above. The user device may further comprise or be connected to a receiver for receiving control commands from the remote-control device for control of said user device.

The optical signals received from the user devices, in accordance with the present invention, comprise high and low signal states, for example high and low optical intensities or on/off modulation. In the optical signals the high and low signal states constitute signal parts to be sampled at a predetermined receiver clock. The receiver clock is predetermined in the sense that the code is designed to be sampled at a predetermined rate, called the predetermined receiver clock. The actual rate of sampling in the remote-control device has to occur at an actual receiver clock having at least about the clock rate of the predetermined receiver clock. The proposed codes achieve an allowable range for the actual transmitter and receiver clock rates, i.e. taking into account clock tolerance and jitter due to various causes. Actual ranges are discussed further below.

Each optical signal comprises a signal pattern of signal parts, the signal pattern uniquely identifying one of said user devices, for example using an 8-bit identifier. Furthermore, each signal part comprises at least one low signal state during a low period and at least one high signal state during a high period.

The above features have the following effect. The low and high periods have granulated lengths. In traditional codes using traditional channel bits the lengths of the periods are an integral number of clock periods of the receiver clock. However, now the lengths are granulated, which means that at least some lengths are not an integral number of clock periods of the predetermined receiver clock, which is achieved as follows. Granulated lengths correspond to an integer number of clock periods of a transmitter clock. The transmitter clock has a clock ratio to the predetermined receiver clock, the clock ratio being a number larger than one. So in the codes as proposed, the nominal clock frequency of the transmitter clock has said clock ratio to the frequency of the predetermined receiver clock. At least one granulated length is longer than a respective integer number of clock periods of the predetermined receiver clock by a fraction of the clock period of the predetermined receiver clock For example, the shortest granulated length used in the code may be determined by the lowest possible integer number of transmitter clock periods, while being longer than one clock period of the predetermined receiver clock. The difference between said one clock period of the predetermined receiver clock and the shortest granulated length is said predetermined fraction. The actual receiver clock is asynchronous to the transmitter clock and may deviate in frequency from the predetermined receiver clock by a clock tolerance, while also there may be a phase jitter of sample moments of the optical signals based on the actual receiver clock due to various reasons. The predetermined fraction ensures, taking into account the receiver clock tolerance and jitter and further errors, that a number of sample moments corresponding to the nominal length of the high or low period is always within the period of the granulated length. Advantageously, such a granulated length may be detected by an asynchronous receiver clock and a detection range having only two values as explained below.

Further granulated lengths may correspond to multiple clock periods of the predetermined receiver clock while being longer by further predetermined fractions. Alternatively, some of the longer granulated lengths may correspond to an integer number of clock periods of the predetermined receiver clock, requiring a detection range of at least three values. Various embodiments are described below.

Effectively, the granulated lengths are selected to have a nominal length of a selected number of clock periods of the predetermined receiver clock, while being longer by said predetermined fractions. By said fractions, the periods are longer than the corresponding number of clock periods of the predetermined receiver clock but also shorter than a subsequent number of clock periods of the predetermined receiver clock. Compared to integral lengths of high periods of the known code of WO2016/050708 the granulated lengths, on average, are selected to be shorter, which improves the code efficiency. Moreover, the shorter periods are reliably detectable using an actual receiver clock that samples the optical signals as described now.

The invention is, inter alia, based on the following recognition. In the known, traditional code the transmitter clock and the receiver clock are assumed to be equal in clock frequency and asynchronous in phase. Hence the signal parts have predetermined lengths being an integral number of clock cycles. Detecting such lengths may result in sample moments coinciding with both boundaries of the period, and therefore the decoder needs to take into account that both coinciding moments may fall outside the detected length (resulting in the detected length being one below the intended number). However, the decoder needs also to take into account that both coinciding moments may fall inside the detected length (resulting in the detected length being one above the intended number). So, there is a relatively large range of detected values, i.e. 3 possible values, that have to be decoded to the intended number. To improve the code efficiency and reduce said relatively large range, the inventors have proposed the granulated lengths. The granulated lengths are transmitted at a transmitter clock being higher than the predetermined receiver clock. The predetermined granulated lengths used in the new code have said predetermined margin relative to sample moments of the receiver clock. Thereby, it is achieved that the range of detected values is reduced to being the corresponding number or the corresponding number plus one, i.e. 2 possible values.

Optionally, in the optical identification signal the different granulated lengths used in the signal parts to determine the different signal part types only comprise selected lengths corresponding to a sequence of non-consecutive numbers of clock periods of the predetermined receiver clock. In the remote-control device, the processor may further be arranged for error detection upon detecting a length corresponding to a number missing in the sequence. The set of different granulated lengths used in the code of the optical identification signal now intentionally has gaps, i.e. said missing numbers. Such gaps may be called violation zones, i.e. any length detected in the violation zone violates the code, so it must be wrongly detected. As a result of the violation zones, when due to various reasons the detection of the received optical signals is disturbed, the processor may detect erroneous codes when a violating length is found. Advantageously, instead of acting upon an erroneously detected different user device's identifier in a traditional code, the remote-control device may wait for another signal pattern to be detected without errors.

Optionally, in the optical identification signal, each signal part consists of one leading or trailing low signal state during a low period and one high signal state during a high period, and the different signal part types comprise 4 duo-bit types each representing different values of two bits of a data word and one sync type representing a boundary of the data word. Advantageously, each signal part now encodes 2 bits of data of a data word, while also the boundaries of the data word can be easily detected via a signal part of the sync type.

Optionally, in a practical embodiment of the code of the optical identification signal, the clock ratio is 2. At least one granulated length of the low period may be 3 clock periods of the transmitter clock, corresponding to 1.5 clock periods of the predetermined receiver clock. Due to the clock ratio being two, said predetermined fraction is 0.5 of the clock period of the predetermined receiver clock, which advantageously provides substantial margins for deviations of the actual receiver clock. In a further practical embodiment of the code having a clock ratio of 2, the granulated lengths of the low periods include 3 clock periods of the transmitter clock; the granulated lengths of the high period include 3, 9, 16 and 24 clock periods of the transmitter clock for a data signal part type; and the granulated lengths of the high period include 33 clock periods of the transmitter clock for a sync signal part type representing a boundary of the data word. Due to the granulated lengths being 3, 9, 16 and 24, corresponding to nominal lengths of 1, 4, 8, 12 and 16 violating zones are created in the sequence of expected detected lengths, for example a signal pattern including a detected length of 3 or 6 is analyzed to be erroneous. In the exemplary code, the longer granulated lengths 16 and 24 correspond to nominal lengths of 8 and 12, while the validly decodable expected lengths are 7, 8, 9 and 11, 12, 13. For such long periods it has been found to be effective to include a larger range of expected lengths so as to allow substantial deviations of the clock period of the predetermined receiver clock, e.g. 7%. Hence total the sequence of expected lengths is 1, 2, 4, 5, 7, 8, 9, 11, 12, 13, 15, 16, 17, 18, while the missing numbers in the sequence, representing violating lengths, are 3, 6, 10, 14.

The optical sensor may be directional in the sense that it is able to selectively receive at least one optical signal while multiple optical signals are present from different directions. For example, using a camera, the directional optical sensor may be able to establish an incoming direction or differences between incoming directions of received optical signals. As a result, the remote-control device allows a user to point the device in a direction of a user device comprising an optical transmitter, and selectively receive the optical signal transmitted by the device based on its relative location with respect to the remote-control device. The blob-tracker may track locations of individual light spots on the camera sensor when their positions change due to movements caused by user pointing activity or by moving targets. The remote-control device may for example use this incoming direction (based on the position on a camera sensor image) for establishing which device the user is pointing at, and thereby selecting an optical signal from the received optical signals as being the optical signal belonging to the device of interest. For example, the optical signal being closest to image sensor center or having the smallest angle with the transverse central axis through the sensor surface may be considered as belonging to the device pointed at by the user. Alternatively, selection of an optical signal based on the information on the incoming direction of the signal may be performed differently, e.g. by selecting one or more optical signals using signal strength or a priority indicator embedded in the optical signal.

Optionally, the directional sensor is arranged to receive multiple optical signals from multiple directions and the processor is arranged to obtain respective signal patterns in parallel and the select a signal of interest based on a combination of incoming direction and the obtained signals patterns. The processor may be arranged to decode all optical identification signals in parallel from an image and to select the signal(s) of interest based on a combination of position in the image and identification results. Parallel decoding allows significant faster detection/selection in case multiple targets need to be identified. That is because decoding can already start as soon as the device becomes visible on the camera sensor, and the identification could already be finished even before the user is actually pointing at the device. However, the further description mostly assumes selection before detection.

Further preferred embodiments of the device and method according to the invention are given in the appended claims, disclosure of which is incorporated herein by reference.

BRIEF DESCRIPTION OF THE DRAWINGS

These and other aspects of the invention will be apparent from and elucidated further with reference to the embodiments described by way of example in the following description and with reference to the accompanying drawings, in which FIG. 1 schematically illustrates a system, remote-control device, and user device;

FIG. 3 schematically illustrates a code for an optical signal in accordance with the present invention;

FIG. 6 schematically illustrates a second code for an optical signal;

FIG. 7 schematically illustrates a code having violation zones for an optical signal;

FIG. 8 schematically illustrates a further code having violation zones for an optical signal;

The figures are purely diagrammatic and not drawn to scale. In the Figures, elements which correspond to elements already described may have the same reference numerals.

DETAILED DESCRIPTION

Figure 1:
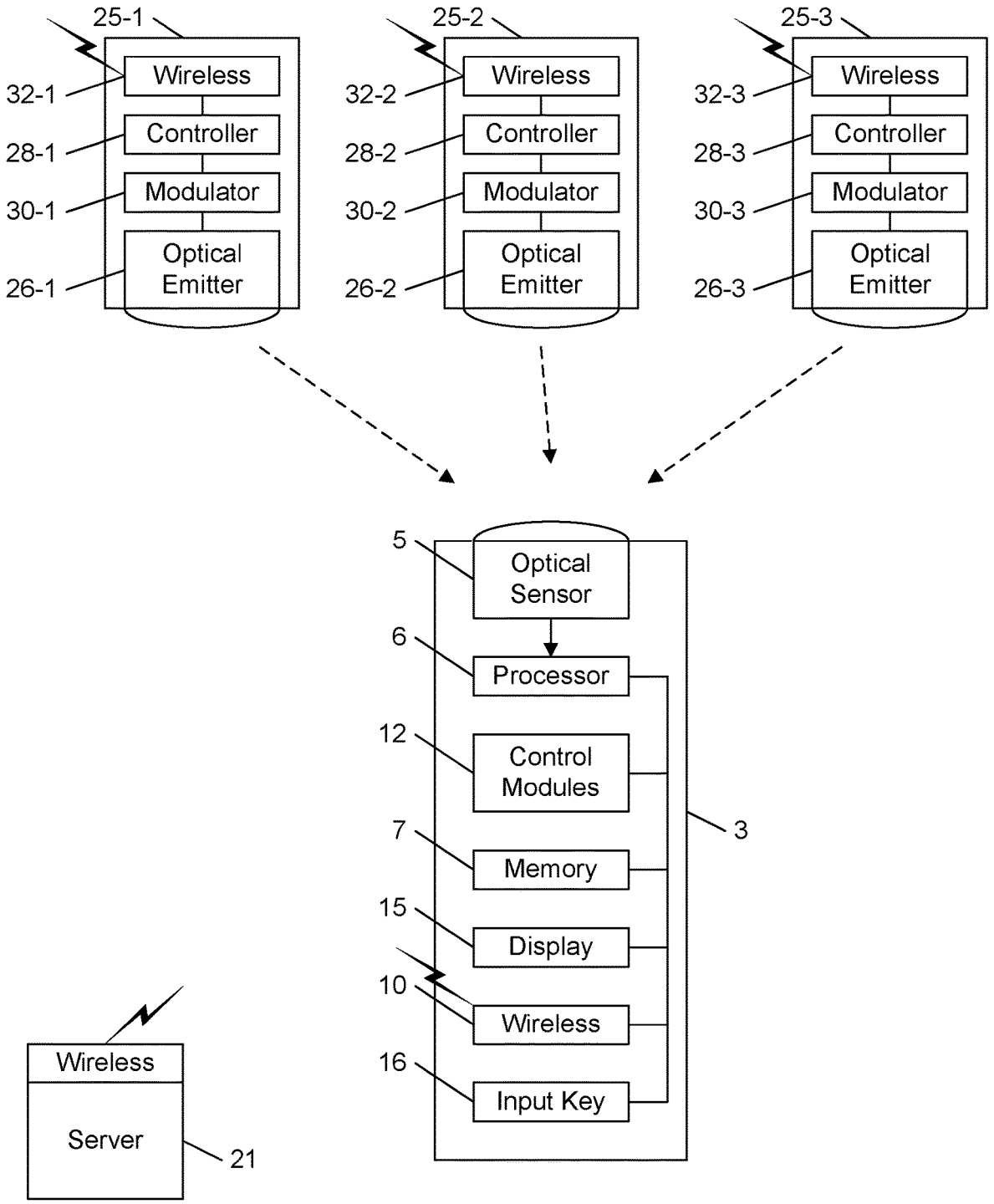

FIG. 1 schematically illustrates a system, remote-control device, and user device. In the figure, the system 1 comprises a remote-control device 3 and a plurality of user devices 25-1, 25-2 and 25-3. The remote-control device 3 comprises a directional optical sensor 5. The directional optical sensor 5 may for example be a camera that provides images to the processor 6 for further analysis thereof. The remote-control 3 also comprises a plurality of control modules 12, which may be hardware control modules or software coded modules. Alternatively, the control modules may be external control modules. Further, a memory or data storage unit 7 and a wireless data communication unit 10 may be comprised by the remote-control device 3. The data communication unit 10 may apply any suitable data communication protocol suitable for controlling user devices, e.g. a radio interface or optical transmission. Also included in remote-control device 3 there may be a (standard or touch sensitive) display screen 15, for providing information to a user and/or receive input from the user. Moreover, the remote-control device 3 may also comprise a keyboard comprising a number of input keys, such as knob 16 for receiving input from the user. Optional, input may also be obtained via gesture detection e.g. based on camera data or motion sensor data, e.g. received from a motion sensor (not shown) like for instance an accelerometer (not shown).

Each of the user devices 25-1, 25-2, and 25-3 at least comprises a number of elements that enable to provide the remote-control device 3 with the device identifier, and to receive or exchange control data such as control commands from the remote-control device 3. In FIG. 1, corresponding elements of each user device 25-1 to 25-3 is indicated with a similar reference numeral comprising a prefix-1, -2, or -3 such as to refer to the respective corresponding user devices 25-1, 25-2, 25-3. Below, the elements of user device 25-1 will be described in more details, but this description likewise applies to the corresponding elements of user device 25-2 and that of user device 25-3.

User device 25-1 comprises a controller 28-1. The user device 25-1 may have a memory (not shown), e.g. including therein a stored device identifier, although this is not required. An identifier may be made available in device 25-1 in a different manner, e.g. by means of a hardware configurable solution (not shown) such as a set of jumper elements or dip switches. The device 25-1 further comprises an optical transmitter 26-1 which is arranged for providing an optical signal that may be received by remote-control device 3. The optical signal provided by optical transmitter 26-1 may for example be an infrared optical signal, although this is not required per se (an optical signal of any other wavelength may also be applied). The optical signal transmitted by optical transmittal 26-1 is an intensity modulated optical signal which is generated using a modulator 30-1 under the control of controller 28-1. In particular, the controller 28-1 encodes a binary identifier of user device 25-1 into a plurality of signal parts, including a header and/or trailer part at the beginning or end of the sequence. Although both a header and a trailer may be included in the optical signal, this is not required in all implementations. In other embodiments either the header or the trailer may be absent, and even both the header and trailer may be absent in embodiments wherein the first and last signal parts may be otherwise recognized. Consecutively, the signal parts assembled are used by the controller 28-1 for controlling the modulator 30-1 such as to modulate the optical signal transmitted by optical transmitter 26-1 to be composed of the signal parts assembled. The manner of coding the identifier of user device 25-1 into the various signal parts will be explained later. User devices 25-2 and 25-3 operate in a similar manner. Optionally, the identifiers may be preprogrammed in a memory or other element of the devices 25-1, 25-2, or 25-3. However, another option is that such identifiers are provided by or managed using a server. This server could be external to the remote-control device 3 and to the other devices 25-1 to 25-3, or could be integrated with any of the devices (3, 25-1, 25-2, 25-3) present in the system. In FIG. 1 an optional server or management unit 21 is shown that interfaces both device 3 and devices 25, such as to keep the design of device 3 simple. This server or management unit 21 can be responsible for handing out (local network unique) identifiers like an internet address. Identifiers might also be hardcoded at the media access layer or data link layer (OSI model) and unique like or being a MAC address in most IEEE 802 network technologies like Ethernet, 802.11 wireless networks, Bluetooth, etc. Another identifier assignment could be based on pairing techniques where a control device is brought in close contact to the beacon after which the control device recognizes the beacon and assigns an identification code.

In the system illustrated in FIG. 1, there are three devices 25-1, 25-2 and 25-3 that can be controlled. These devices may represent lamps, photo frames, air control devices, audio systems, game consoles, televisions, media players, etc. Each device 25-1, 25-2 and 25-3 comprises an optical transmitter 26-1, 26-2 and 26-3 that is operable as a beacon for optical communication with the remote-control device 3. The beacons 26-1, 26-2 and 26-3 are arranged for transmitting an optical modulated signal at infrared wavelength. The optical signal is preferably omnidirectional, i.e. transmitted in many directions and not particularly focused in a specific direction, such that it can be received in a large part of the room wherein the devices 25-1 to 25-3 are located.

In an embodiment of the above remote-control device, the directional sensor is arranged to detect an incoming direction or differences between incoming directions of received optical signals, and the processor is arranged for selecting the at least one of said received optical signals for analyzing thereof, wherein the selection is dependent on a detected incoming direction of said received optical signals. Alternatively, all optical signals are decoded in parallel and selection can be done afterwards when at least one of the signal sources has been identified. Optionally, the processor may be arranged for tracking the one or more optical signals upon changing of said incoming direction. Advantageously the directional sensor enables selectively controlling a user-device based on the direction of the incoming optical signals.

Different embodiments of the remote-control device may be based on different types of directional optical sensors. For example, in accordance with an embodiment, the directional optical sensor is a camera for providing images to the processor for performing said analysis. However, in accordance with another embodiment, the directional optical sensor comprises a suitable arrangement or grouping of p-i-n photodiodes (shortly: PIN diodes) which allows to establish the incoming direction of received optical signals.

In an embodiment of the user device, the user device comprises a plurality of optical transmitters for transmitting said optical signals. Advantageously, the remote-control device may be enabled to establish a spatial orientation or location of said user device.

The beacons 26-1 to 26-3 send out an optical signal comprising a code containing their device identification information. The devices 25-1 to 25-3 may be arranged for sending out the code continuously while switched on, or may be arranged for sending out the code in response to any event or trigger signal. For example, in some embodiments, a general trigger may be transmitted by the remote-control device 3 when it is picked up by a user, e.g. in response to a signal from an acceleration sensor (not shown) comprised by the remote-control device 3. In other embodiments, a user may operate knob 16 on the remote-control device 3 to send a general trigger signal.

Figure 2:
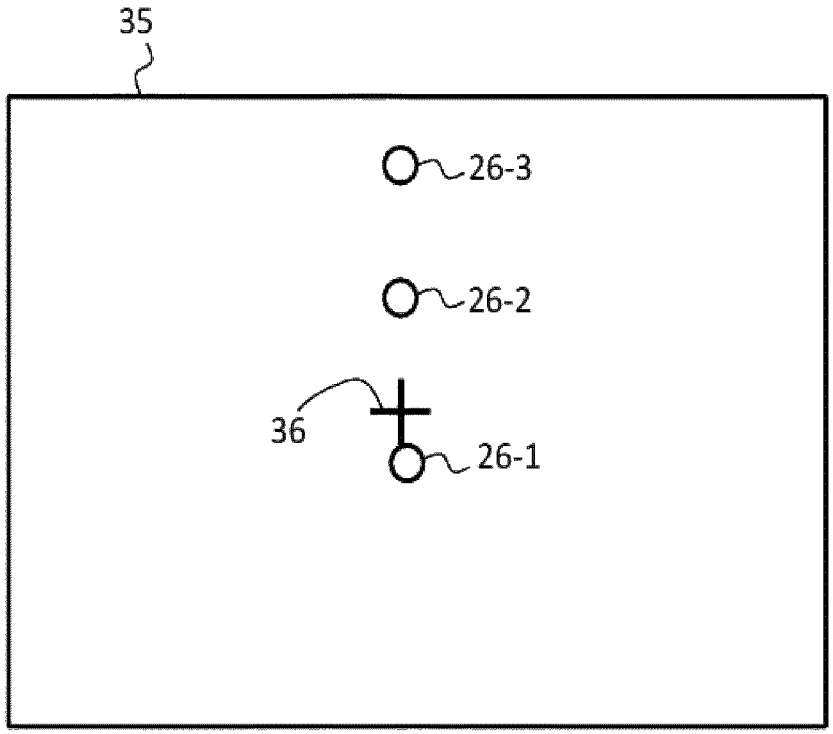
FIG. 2 schematically illustrates an image received by the remote-control device of FIG. 1.

FIG. 2 schematically illustrates an image received by the remote-control device of FIG. 1. To identify a specific device 25-1 for control thereof, the user points with the remote device 3 in the direction of the device 25-1 that he wants to select. The camera 5 in the remote-control device 3 captures an image that could look like the image illustrated in FIG. 2. In case the optical sensor 5 has a large view angle, a number of beacons 26-1, 26-2 and 26-3 will be visible in the image as illustrated in FIG. 2. Further, as result of the optics of the optical sensor 5, the sensor image 35 is a mirrored projection of the environment imaged (point-symmetric vis-à-vis the center 36 of the image, with top becoming bottom, and left becoming right). Devices that are seen by the camera under different angles with respect to the central axis will be presented at different locations on the image 35. However, in order not to obscure the comprehensibility of the example for the present teaching, it is assumed here that the devices 25-1, 25-2 and 25-3 are located on top of each other, as illustrated in FIG. 1. The optical transmitter or beacon 26-1 at which the user is pointing at with remote-control device 3 will be closest to the image sensor center 36 as indicated in FIG. 2. Based on this, the processor 6 of the remote-control device 3 may select device 25-1 as being the device to be controlled, and starts keeping track of the signal transmitted by optical transmitter 26-1. Alternatively, other selection criteria may be used for selecting the device to be controlled. Moreover, this selection does not have to take place immediately upon receipt of one or more optical signals, but could take place simultaneous with other steps of the identification process or all at the end.

Signal processing in the remote-control device 3 first detects the blob regions (=area, boundary of individual light spots) corresponding with optical transmitters 26-1, 26-2 and 26-3 in the image 35. Next blob position and intensity features are extracted from the detected blobs. From the sample image 35 illustrated in FIG. 2 it is possible to extract features such as position coordinate x in the image 35, position coordinate y in the image 35, intensity of each blob, wavelength, angle with respect to a central axis 20 (see FIG. 1), and possible other features that may contribute to identification and selection.

As may be appreciated, during analysis of a received optical signal from a user device, the user holding the remote-control device 3 may usually not be able to hold the remote-control device 3 completely still. Therefore, in case the user intends to control user device 25-1, as a result of motion of the hands of the user the optical signal corresponding with optical transmitter 26-1 (e.g. as illustrated in FIG. 2) will be moving in the image 35 during analysis. As will be explained below, the processor 6 of the remote-control device 3 will keep track of the optical signal in the image received. As long as the optical signal is transmitted with a high signal state, keeping track of the optical signal corresponding with transmitter 26-1 in the image 35 may be straightforward using standard algorithms. However, as soon as the optical signal takes on a low signal state, the processor may no longer be able to keep track of the signal of optical transmitter 26-1 in the image 35. The processor may lose track of signal only after not seeing the blob a number of consecutive frames. If it does not see it for a possible low period, e.g. one or two frames, the interruption is recognized as a 'low' state. Meanwhile tracking will continue, even though the particular blob was not seen.

If the high signal state and low signal state correspond to the optical transmitter being 'on' and 'off', in particular during the 'off' times, the optical signal may get lost. However, also in those cases where the optical signal is modulated between high and low intensities, but is not switched off completely during the low signal state, the signal-to-noise ratio (SNR) during the low signal states will still be considerably lower in comparison with the SNR during the high signal state. In order to optimize blob tracking, a code may be used with maximum number of high state periods and minimal number of low state periods. Preferably, the duration of the low signal states is minimized in comparison to the duration of the high signal states. The low signal states may have fixed and minimal durations and serve primarily as delimiters of the high signal states. The low signal states, in this case, enable the processor 6 to recognize the high signal states and to measure their duration in time. The information to be conveyed in this embodiment is encoded in the duration of the high signal states.

In an embodiment of the code, the duration of the high signal states may be selected to be longer than durations of the low signal states. For example, the granulated lengths of the low periods may only be the shortest possible length and the one but shortest. The optical signals established in this way, are optimized for being 'followable' by the remote-control device. This is due to the fact that low states cannot be followed as there is no light. For example, if the optical signal is an on-off modulated optical signal, it is important that the provided optical signal consists mainly of 'on' states with only few 'off' states. This is due to the fact that the optical signal can be easily followed as long as it is in 'on' state (or high signal state). However, while being in the 'off' state, the remote-control loses track of the signal.

The optical signals as provided with the above codes allows to carry data including an identifier, and may be optimized for enabling to keep track of the signal by the above remote-control device, in case the remote-control device is not steadily held by a user while pointing at a user device. This type of signal is therefore advantageous for conveying an identifier signal remotely via an air interface to a hand-held device receiving it.

In the proposed methods and arrangements, the signal patterns representing the identifier or message may be transmitted back-to-back, and a receiver can start decoding on the fly at any moment in time (so even halfway transmission code). When waiting for a preamble is required, an average delay of 50% of transmission length may be introduced (maximum 100%). The proposed receiver starts decoding immediate, and saves on average 50% transmission length detection time (maximum 100%). The receiver will be able to detect a signal pattern when all its signal parts are in a signal fragment of back-to-back repeated code words, even having the sync signal part in the middle. So, the ID or message may constantly be transmitted, the sync being present both before and after the payload. Now the receiver can accept the sync either before or after, or even in the middle of the payload if multiple signal parts are used for the datawords of a message.

FIG. 3 schematically illustrates a code for an optical signal in accordance with the present invention. The code defines how to encode an identifier of one of the user devices (25-1, 25-2, 25-3) into an optical signal for transmission. In the exemplary embodiment of the code, each signal part consists of one leading or trailing low signal state during a low period and one high signal state during a high period. The different signal part types may include 4 duo-bit types each representing different values of two bits of a data word, also called bit pairs. The code also has one sync type representing a boundary of the data word. The physical layer message format of identification messages may be as follows. The format starts with a header symbol for synchronization purposes. The header is unique and cannot occur in data symbols. The header is encoded by the sync type.

The optical signal comprises a sequence of signal parts, e.g. a sync signal part followed by 4 data signal parts, which may also be called payload signal parts. A sync signal part may precede the payload part as a header, and/or may follow the payload parts to constitute a trailer signal part indicating the end of the optical signal. In the example, the identifier may consist of 8 data bits. The 8 bits of the identifier are sub-divided by controller 28-1 of the user device 25-1 into bit pairs. Each bit pair comprises two bits of the 8 bit identifier. As may be appreciated, in different implementations it is also possible to encode single bits or triplets of bits or a different number of bits; the number of bits encoded in each signal part may be chosen by the skilled person.

Each bit pair is encoded in a respective payload signal part. Assuming that the identification code is N-bits wide, a complete message may contain (1+N bits/2) marks, and the same amount of spaces. The above bit pairs are mapped into variable length channel symbols according to a code table. The bit pairs may be encoded such that their information is conveyed in the duration of the high signal state of the optical signal.

A decoder implementation receives blob brightness data as input, where 'mark' can be detected as brightness signal available. 'space' can be detected as blob is in blob tracker memory but no or a low brightness signal. The duration of mark- and space-events can be counted in units of the sample clock (=camera frame rate FPS), also called the actual receiver clock.

As transmission- and receiver-clocks run asynchronously, the actual receiver clock could run slower compared to design value (called the predetermined receiver clock). In a similar way, the actual transmission clock can run slower or faster than design value transmission clock. As a result, the received symbol durations differ from the ideal transmitted symbol durations. Therefor the decoder needs to accept some variation on the received symbol length. The channel symbols can be decoded with a channel decoder table having, for respective received durations, the corresponding signal part type, e.g. the bit pair value or sync type. The channel decoder table may keep maximum and minimum symbol durations for each possible channel symbol. The channel decoder looks up (valid) received mark and space durations. A data decoder state machine may be triggered by reception of the sync symbol and may reconstruct the identification data based on the detected signal part types.

In the embodiment, the various possible bit configurations of each bit pair may be encoded and decoded based on in the code in the table shown in FIG. 3. The table has the following rows defining the parameters of the exemplary code:

Camera frame rate 120 Hz; defining the predetermined receiver clock rate. The camera sampling rate, or frame rate is set to 120 Hz. Due to a sliding shutter design the actual moment of blob sampling may depend on the blob position in the sensor field. This causes a sampling jitter that depends on the maximum speed of move that we allow during detection of identification codes. The maximum speed of move is coupled to the threshold value as set in the blob tracker. For example, with an assumption of a blob detection threshold of 75 pixels (on an image of 768 pixels), the maximum sampling jitter becomes 1/120*75/768=0.814 ms. In practice, the threshold may be smaller, but 75 pixels could be an upper bound to specify maximum sample process jitter.

Payload length 8 bits; defining the length of the data word or identifier.

Blob tracker threshold 100 pixels; defining the capability of tracking an optical signal in a camera image during movements of the user.

Beacon clock jitter 0.1 ms pk; defining the peak level of jitter in the transmitter clock. In practice, the identification code may be generated by a microcontroller. Timing jitter may occur, but may be significantly smaller compared to sensor jitter. A reasonable maximum timing jitter of beacon code generation is 30 μs.

Target clock tolerance 3.0%; defining the minimum receiver clock tolerance.

Minimum decoder length 1 clks; defining the shortest detectable length in clock period of the predetermined receiver clock.

Violation zone 0 clks; defining whether the sequence of detectable lengths has missing numbers for error detection.

TxClk/RxClk ratio 2.0; defining the clock ratio between the transmitter clock and the predetermined receiver clock.

Signal parts. The table lists 5 signal parts, indicated by a label like "b00", followed by the nominal length in clock periods of the predetermined receiver clock, the granulated length in clock periods of the predetermined receiver clock, and the minimum and maximum lengths of the clock period of the predetermined receiver clock for correct detection:

| | | | | | |
|---|---|---|---|---|---|
| b00 | 1 | 1.5 | 2 | 0.738 | 1.258 |
| b01 | 3 | 3.5 | 4 | 0.888 | 1.111 |
| b02 | 5 | 5.5 | 6 | 0.929 | 1.071 |
| b03 | 7 | 7.5 | 8 | 0.948 | 1.052 |
| b04 | 9 | 9.5 | 10 | 0.959 | 1.041 |

The signal parts b00 to b03 may encode two bits, such as the above bit pairs. The signal part b04 may encode the sync signal part.

Duration. Not all payload values will result in the same transmission length. The exemplary coding system has fixed length sync symbol, fixed space duration and variable length mark duration. This makes that the code length (expressed in clocks of the predetermined receiver clock) and transmission duration (in seconds] depend on the code content. Due to the encoding identification information with more '0' will result in faster messages as identification information with more '1'. Code length depends on the number of bits encoded in the messages, while faster transmission can be reached by using shorter payload length or by allowing only a subset of all available code words. The table lists the duration of the signal patterns for the above parameters of the code, by the minimum, average and maximum values in clock periods of the predetermined receiver clock and in time.

Duration Min 23.0 Avg 35.0 Max 47.0 clks

Duration Min 0.2 Avg 0.3 Max 0.4 s

Relative pointer speed limit 0.333; defining the relative speed of movement for tracking a signal having low signal states as defined in the code. The pointer speed during selection process is limited by the maximum run length of the low signal state in the coded signal. The blob tracker may operate with a fixed threshold and allow only maximum displacement between successive blob detections. Consequence is a speed limit inverse proportional with space run length:

$$\omega_{max} = \frac{\omega_{maxcursorpointing}}{1 + \text{longest space run}}$$

Pointer speeds may be expressed in [rad/s]

Overall system clock tolerance 4.104%; defining the resulting allowed deviating of the actual receiver clock from the predetermined receiver clock.

The encoding of the code according to the above parameters may be performed by the controller 28-1 of user device 25-1. Then, the controller operates the modulator 30-1 for modulating the optical signal transmitted by optical transmitter 26-1. The decoding of the code according to the above parameters may be performed by the processor 6 of the remote-control device 3. In the example, the granulated lengths expressed in transmitter clock periods are 3, 7, 11, 15 and 19. For all granulated lengths used in the code there is a fraction of 0.5 clock period of the predetermined receiver clock.

For decoding in the above example with reference to FIG. 3, the expected range of detected values always is 2, i.e. the nominal length and that value plus one. The decoding in the processor of the remote-control device may thereto have a table of expected values and corresponding nominal values, or sequences of expected values and corresponding signal parts. For the longest used length of 9.5 clock periods of the predetermined receiver clock the clock margin is most severe, at 4.1% which determines the overall system clock tolerance. Actual clock tolerances of receiver and transmitter clock together should be within this overall tolerance. In further embodiments, e.g. as shown in FIGS. 6-8, other granulated lengths have been selected. In such codes the clock margin is different, as indicated in the respective Figures by the minimum and maximum lengths of the clock period of the predetermined receiver clock for correct detection.

The identification code detection system may, as opposed to most communication systems, not be noise limited. Instead, a root cause of errors is in loss of the brightness signal. That happens when the blob crosses sensor boundaries, but also when objects occur in between line of sight from beacon to sensor. In both cases the receiver will detect more low signal state than the amount that was transmitted. Another reason to lose brightness signal could be caused by blob tracker errors. Some light source can take over the blob id position of another source, which may affect both low and high periods. In order to minimize detection failures, the decoder may check both leading space and trailing space run length.

In an embodiment, the processor is arranged to decode the signal parts by, for each signal part, detecting the length of the high period. For a code that also have multiple granulated lengths for the low period, also called spaces, the processor may be arranged to, for each signal part, detect the length of the high period and separately detect the length of an adjacent low signal period. Based on both detected lengths the respective signal part can be decoded. Alternatively, the processor may be arranged to detect, for each signal part, a combination of a high period and a low period, by, for example, detecting the length of the high period and detecting the length of the preceding and/or following low signal period. The detected combination is subsequently decoded into the respective signal part type.

In an embodiment of the remote-control system, multiple codes may be used in the same environment, e.g. different user devices using identifiers or data words of different lengths, e.g. 8 bits and 12 bits. For distinguishing the various codes, requiring accommodating one or more optical received signals having respective different signal patterns according to respective different code systems, each code system may have a respective different sync signal part type representing a boundary of the data word. The correctly decode different code systems, the processor may be arranged to detect a respective one of the code systems based on a respective different sync signal part. Subsequently, the processor will decode the signal parts according to the respective one of the code systems, e.g. using respective different decoding tables.

Figure 4:
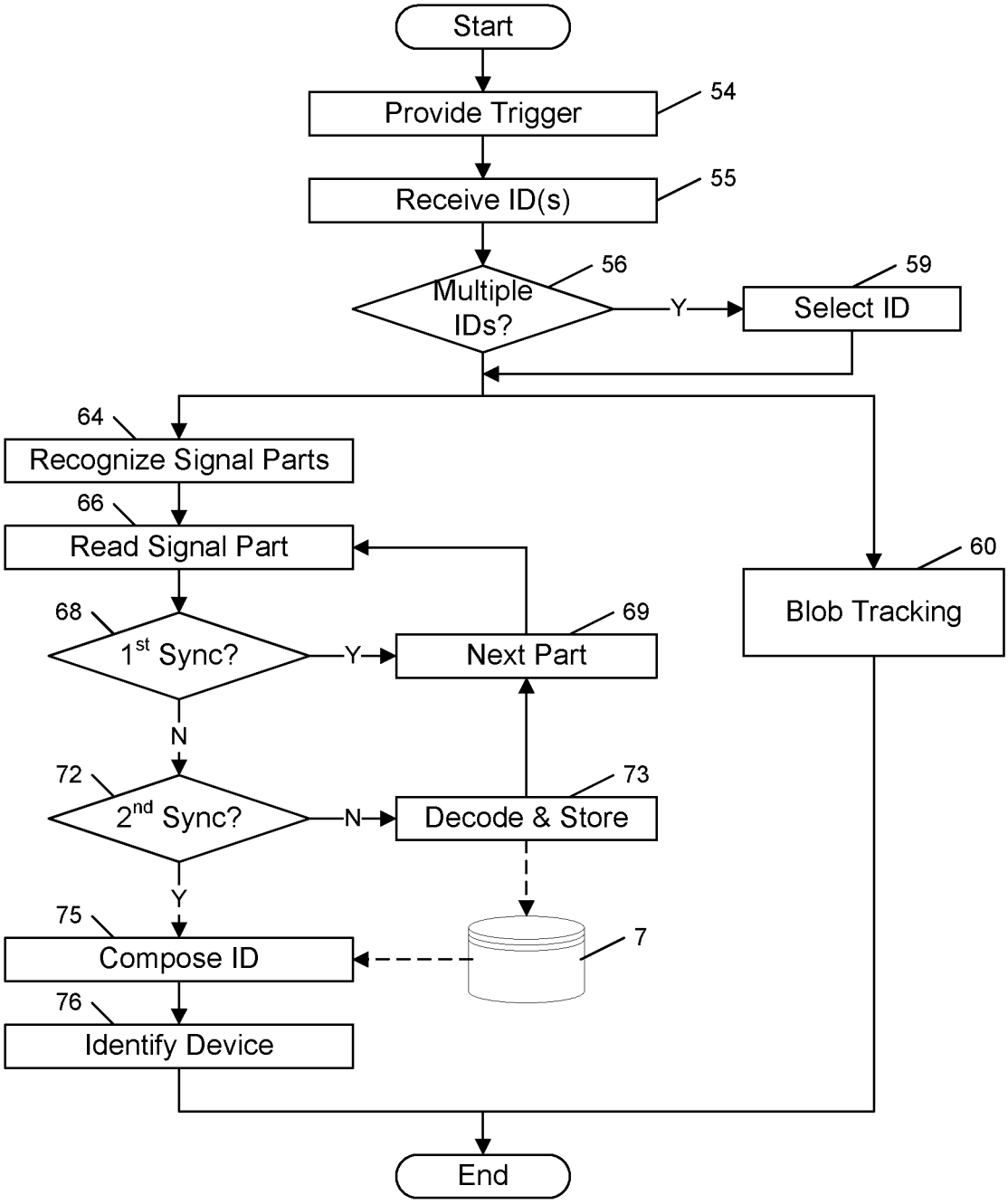
FIG. 4 schematically illustrates a method of analyzing optical signals for identification of one or more user devices in a remote-control device in accordance with the present invention.

FIG. 4 schematically illustrates a method of analyzing optical signals for identification of one or more user devices in a remote-control device in accordance with the present invention. Optionally, the method starts in step 54 by the remote-control device 3 providing a trigger signal e.g. via the data communication unit 10 to all devices in the environment for triggering the user devices 25-1 to 25-3 to start transmitting an optical identifier signal. In a different implementation, the optical identifier signals may for example continuously be sent in a repeating manner by the devices 25-1 to 25-3 and in that case, the method starts by receiving the optical identifier signals in step 55 when the remote-control device is pointed at the devices 25-1 to 25-3. A further option is that the optical identifier signal is repeated a predetermined number of times (e.g. 1×, 2×, 3×, 4×, 5×, 6×, . . . ) after receipt of a trigger by the devices 25-1 to 25-3 provided by remote-control device 3. In order to prevent transmission pauses in between optical identifier signals, when repeating the optical identifier signal, after a trailer of the current optical identifier signal immediately the header of the next repeated optical identifier signal may be transmitted. In this case the leading zero of the header symbol overlaps with the trailer symbol of the previous identifier. Another option is that the remote-control device is in sleep mode, and some internal trigger (e.g. the generated due to user operation of the remote-control device 3) is required to wake-up the remote-control device 3 to start receiving the optical signals in step 55. In any event, the optical signals transmitted by one or more user devices 25-1 to 25-3 are received in step 55 of the method in FIG. 4. Step 54 may either be done only once, or every so many frames repeated. Step 55 may also either be once ('turn on camera') or every frame ('receive frame').

In step 56 it is determined by the processor whether the image contains only a single optical signal or whether multiple optical signals are present in the image received from the directional optical sensor 5. In case multiple optical signals are present in the image 35 received from optical sensor 5, a method continues in step 59 wherein at least one of the received optical signals is selected as the candidate optical signal for the user device to be controlled. Steps 56,59 may be repeated frame based. As may be appreciated, dependent on the implementation also more than one received optical signal may be selected as a candidate signal. Moreover, the step of selection of the candidate signal may be performed either at the beginning of the method (as illustrated in FIG. 4) or during any of the subsequent steps, or even all at the end of the method.

Method step 60 and the sequence of steps 64 through 76 are then performed simultaneously, e.g. as parallel threads. In method step 60 (right thread) the processor 6 performs blob tracking by keeping track of the at least one optical signal selected in step 59, and the processor must keep track of this signal for as long as the optical signal is being received and analyzed, at least until the signal pattern has been completely received. The left thread (steps 64-76) may also involve some repetition to decode the sync and payload of one or more optical signals. It is noted that the specific order of these steps for recognizing signal payload parts and sync parts may be different depending on the actual code. Finally, both threads end after an identifier is recognized.

In the example, while the processor 6 keeps track of the at least one optical signal, the processor also starts analyzing the at least one optical signal in steps 64 through 76. In step 64, the processor 6 recognizes the signal parts that are present in the optical signal, e.g. by recognizing the locations of the low signal states in the optical signal considered. In step 66 the signal part being received is read by the processor, starting with the first signal part. In step 68, the processor determines whether a received signal part is a sync type signal part. The code may have just one sync type indicating the boundary of the data word, or different sync types like a header type and/or a trailer type, or a coded sync type that indicates the code used for encoding the data word.

If the signal part is a sync type signal part, the processor in step 69 waits for the next part and returns to step 66. In case the signal part read in step 66 is not a header type signal part, then in step 72 the processor may determine whether the received signal part is a different type sync signal part. If the signal part is not a sync type signal part, then in step 73 the processor establishes that the signal part is a payload type signal part, and decodes the signal part value represented. The signal part value is stored in memory 7 for later use. For decoding the granulated lengths as discussed above the decoder translates set of the detected lengths of a signal part according to the value ranges associated with the respective granulated lengths. Thereto the associated value ranges may be stored in a decoding table, or in a decoding logic circuit, or in a decoding processor subroutine of instructions.

The method, after step 73, continues with step 69 (wait for the next signal part). If in step 72 the processor determines that a full data word is received, or a next received signal part is a sync type signal part, the method continues in step 75 where the processor 6 retrieves the decoded and stored signal part values from the memory 7 and composes the identifier represented by the optical signal from these signal part values. Then in step 76, using the received identifier of the user device 25-1 the processor 6 identifies the user device 25-1, establishing which device this is. The identification method then ends, and may of course be followed (as usually will be the case) by the user controlling the user device 25-1. The remote-control device may restart the method if the user points in a different direction or may de-activate the remote-control device when put to rest.

Next steps, which are not shown in FIG. 4 but may follow upon the identification method, may for example be the selection of the correct control module 12 by the remote-control device for controlling the identified user device 25-1. For example, various control modules may be present in the remote-control device, either in hardware or software coded, and may be applied by the remote-control device for controlling device 25-1. Alternatively, it is also possible that the remote-control device, upon identifying the type of device 25-1, retrieves the correct control module and may be a relevant user interface, from an external source. This might be the server or management unit 21. It can receive such information from server 21 direct or indirect, i.e. server 21 might be part and hence connected to a larger network (and even intranet or internet). For example, the remote-control device may retrieve the control module or user interface from the device 25-1 itself, or it may be retrieved from a remote server. Then, upon receiving input from the user, the remote-control device sends control commands to the user device 25-1 by means of the data communication unit 10, and the corresponding data communication unit 32-1 of user device 25-1.

Another option for analyzing that may be implemented is the possibility to select more than one optical signal (blob) in a single selection action. This may for example be indicated prior to performing the identification and analysis steps. For example, all blob positions and identification information may be in the memory 7 of the remote-control 3. Alternatively, this data may be obtained by the remote-control device 7 from the server 21. Selection of optical identifier signals could be based on a relation between their positions and/or identification codes. Possibilities are for example the selection of a group of devices (each device equipped with single beacon) or detection of an orientation of a device relative to the remote-control and/or a room. In this latter case, device 25-1 can be equipped with number of beacons that for example transmit the same, similar or different unique identifiers (one user device having multiple identifiers) for allowing the remote-control device 3 to recognize and select all corresponding signals. From the image, if the remote-control device 3 is aware of the positions of each optical transmitter on the device 25-1, the orientation or relative position may be calculated and a corresponding control function may be engaged (with or without aid from the server 21).

Figure 5:
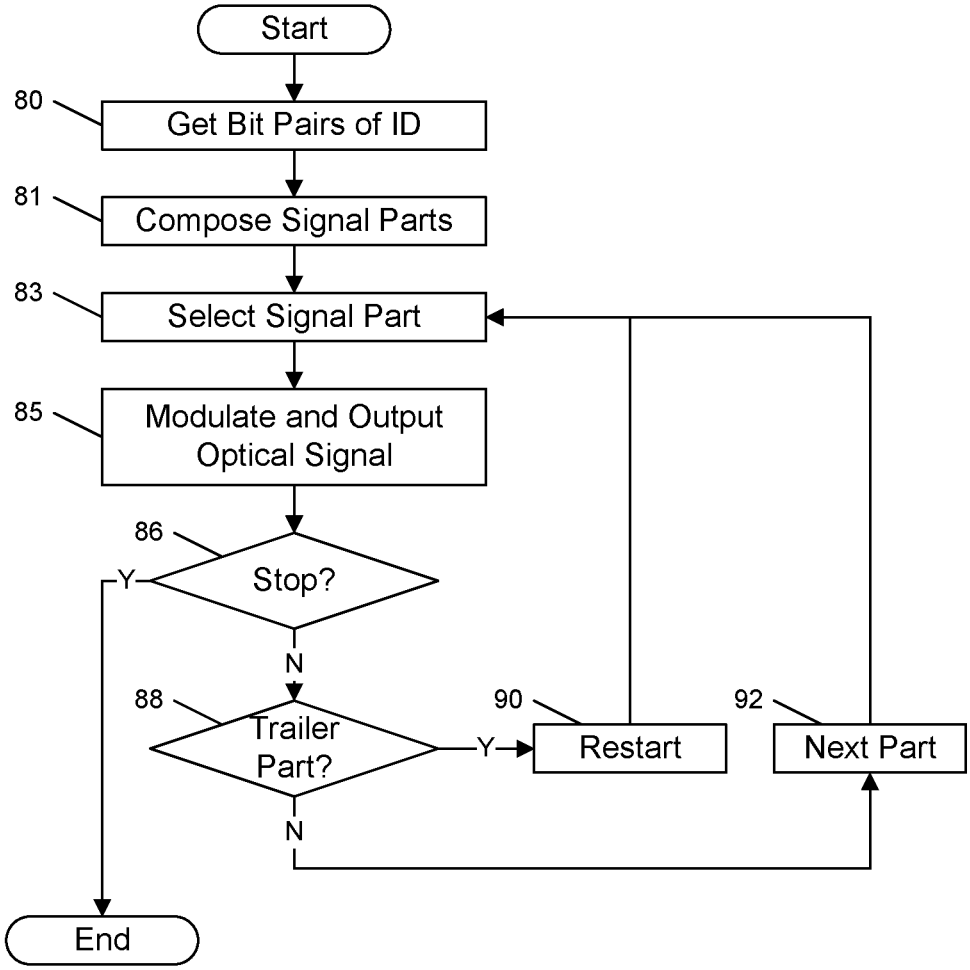
FIG. 5 schematically illustrates a method of composing an optical signal for identification of a user device.

FIG. 5 schematically illustrates a method of composing an optical signal for identification of a user device. The method may be applied in a user device 25-1. The method of FIG. 5 starts in step 80, where the user device identifier of the user device is separated into bit pairs. From the separated bit pairs, in step 81 the controller 28-1 of the user device 25-1 composes the signal parts, preceded and/or terminated by a sync type signal part. In step 83, the controller 28-1 selects the parts to be sent (e.g. header first, second, third . . . etc.). Then in step 85, the controller operates the modulator 30-1 in accordance with the periods of high signal state and low signal state of which the signal parts considered is composed. For example, the modulator may apply a high signal state when it receives a '1' from the controller 28-1, and a low signal state when it receives a '0' from the controller 28-1.

A data signal is provided to the modulator for enabling modulation of the optical signal in accordance with a signal pattern of signal parts. The signal pattern uniquely identifies the user device. The optical signal now has high and low signal states constituting the signal parts to be sampled at a predetermined receiver clock. Each signal part has at least one low signal state during a low period and at least one high signal state during a high period. The low and high periods have granulated lengths, while the timing of the periods is controlled using a transmitter clock. The different granulated lengths determine different signal part types. For encoding actual data bits of the identifier into signal parts, the respective granulated lengths may be derived from a coding table stored in the controller, or in an encoder circuit or encoding subroutine program executed by the processor. In the encoding, each granulated length is longer than one clock period of the predetermined receiver clock and is an integer number of clock periods of the transmitter clock. The transmitter clock has a clock ratio to the predetermined receiver clock. The clock ratio is a number larger than one. The ratio may, for example, be an integer ratio of 2, 3 or 4, or a rational number like 2.5. A rational number is a number that can be written as a ratio. That means it can be written as a fraction, in which both the numerator (the number on top) and the denominator (the number on the bottom) are whole numbers.

Thus, in step 85, the optical signal is transmitted by the optical transmitter 26-1, which is connected to the modulator to receives the granulated lengths for the high and low signal states.

In step 86, the controller 28-1 may verify whether the method can be stopped. For example, this may be in response to receiving an interrupt signal, or in response to any other event taking place within user device 25-1. Usually, the optical signal will be retransmitted from start after the last signal part has been transmitted. A guarding interval is not desired in order to maintain tracking. Alternatively, at some point the controller 28-1 may decide that transmission is no longer necessary, and may stop the transmission in step 86. In other embodiments, the user devices 25-1 may be arranged for continuously transmitting the optical signal without stopping. In case the method does not have to be stopped in step 86, it continues in step 88 wherein the controller 28-1 may determine whether the transmitted signal part was a trailer signal part. If the last transmitted signal part was a trailer signal part, the method continues in step 90 wherein transmission is restarted from the first signal part of the optical signal. Step 90 is thus a restart step, and the method continues again in step 83 (selection of the signal part to be sent).

If in step 88 it is determined that the last sent signal part is not a trailer type signal part, the method continues in step 92 indicating to the controller that the next signal part is to be selected for transmission. Thereafter, the method again continues in step 83. Optionally, the device 25-1 or the remote-control 3 may provide user feedback. For example, on the device a LED signal or other indicator (e.g. visible or audible) may be provided after selection or after becoming selection candidate.

FIG. 6 schematically illustrates a second code for an optical signal in accordance with the present invention. The table as shown in the Figure has the same rows as described with reference to FIG. 3. In the embodiment, the longer granulated lengths are set to have a larger expected range of detected values of 3, i.e. the nominal length and that value plus one, and that value minus one. The processor is arranged to decode the signal parts having a range of expected values that decodes a detected length to a respective nominal length, while the range of expected values has two values for the shorter high or low periods, while having at least three values for at least one longer high or low period. In such codes the clock margin for the longer lengths is less severe, as indicated by the minimum and maximum lengths of the clock period of the predetermined receiver clock for correct detection in the respective Figures. In the example, for accommodating the higher target clock tolerance of 6%, the longer granulated lengths in the code have been selected to be 16 and 22 transmitter clock periods, while the expected range of detected values is 3 for those lengths. The most severe clock tolerance is found at the granulated length 5.5, being 7.1%.

Error correction methods are not relevant for an identification system using short message length. Significant overhead would be required and that would drop the code efficiency significant downwards. Optionally said violation zones are included in the granulated lengths for error detection to prevent decoder failures from happening. Codes with violation space allow detection of bad code sequences due to continuity of the brightness signal. Violation space may increase the code length.

FIG. 7 schematically illustrates a code having violation zones for an optical signal in accordance with the present invention. The table as shown in the Figure has the same rows as described with reference to FIG. 3. In the exemplary embodiment, the different granulated lengths used in the signal parts to determine the different signal part types only comprise selected lengths corresponding to a sequence of non-consecutive numbers of clock periods of the predetermined receiver clock. The violation zones coincide with the missing numbers. In the remote-control device, the processor is further arranged for error detection upon detecting a length corresponding to a number missing in the sequence.

In the example, for accommodating a higher target clock tolerance of 4% and enabling a violation zone of 1 clock period, the granulated lengths in the code have been selected to be 3, 9, 15, 24 and 32 transmitter clock periods, while the expected range of detected values is 3 for the lengths 24 and 32. The most severe clock tolerance is found at the granulated length 7.5, being 5.2%. Due to the violation zones, there are missing lengths when correctly decoding. The missing expected lengths in the decoder tables are 3, 6, 9 and 13, which values, when detected, will be marked as erroneous.

FIG. 8 schematically illustrates a further code having violation zones for an optical signal in accordance with the present invention. The table as shown in the Figure has the same rows as described with reference to FIG. 3. For accommodating a higher target clock tolerance of 6% and enabling a violation zone of 1 clock period, the granulated lengths in the code have been selected to be 3, 9, 16, 24 and 33 transmitter clock periods, while the expected range of detected values is 3 for the lengths 16 and 24, while being 4 for the length 33. The most severe clock tolerance is found at the granulated length 12, being 7.4%. Due to the violation zones, there are missing lengths when correctly decoding. The missing expected lengths in the decoder tables are 3, 6, 10 and 14, which values, when detected, will be marked as erroneous.

Further extensions of the above code system may be as follows. As the sync words are unique in the code system, it is possible to insert a variable number of transmission symbols between sync symbols. The decoder may be arranged to handle the variable number of symbols by initially detecting a unique sync signal part. Also, for extending the code by using new channel symbols, additional sync signal parts could be defined. Corresponding decoders are arranged to detect the additional min- and max-durations, to make sure that such new symbols are uniquely detected and not confused with previously defined sync signal parts.

The present invention has been described in terms of some specific embodiments thereof. It will be appreciated that the embodiments shown in the drawings and described herein are intended for illustrated purposes only and are not by any manner or means intended to be restrictive on the invention. For example, the method steps illustrated in the figures and described above only represent a possible implementation of the invention. The order in which the steps are performed may be different, and even some steps may be dispensed with in a different implementation. The invention may be implemented by means of hardware comprising several distinct elements, and/or by means of a suitably programmed computer or processor system. Respective programs may implement, at least in part, the above described methods when executed by such computer or processor systems.

Figure 9:
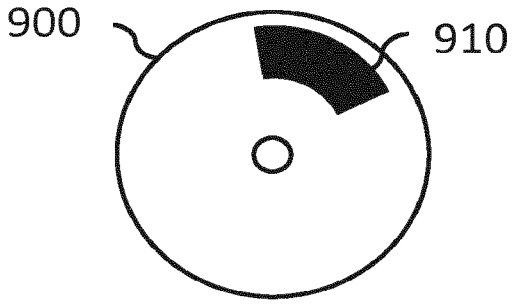
FIG. 9 shows a transitory or non-transitory computer readable medium.

FIG. 9 shows a transitory or non-transitory computer readable medium, e.g. an optical disc 900. As also illustrated in the Figure, instructions for the computer, e.g., executable code, may be stored on the computer readable medium 900, e.g., in the form of a series 910 of machine readable physical marks and/or as a series of elements having different electrical, e.g., magnetic, or optical properties or values. The executable code may be stored in a transitory or non-transitory manner. Examples of computer readable mediums include memory devices, optical storage devices, integrated circuits, servers, online software, etc.

Figure 10:
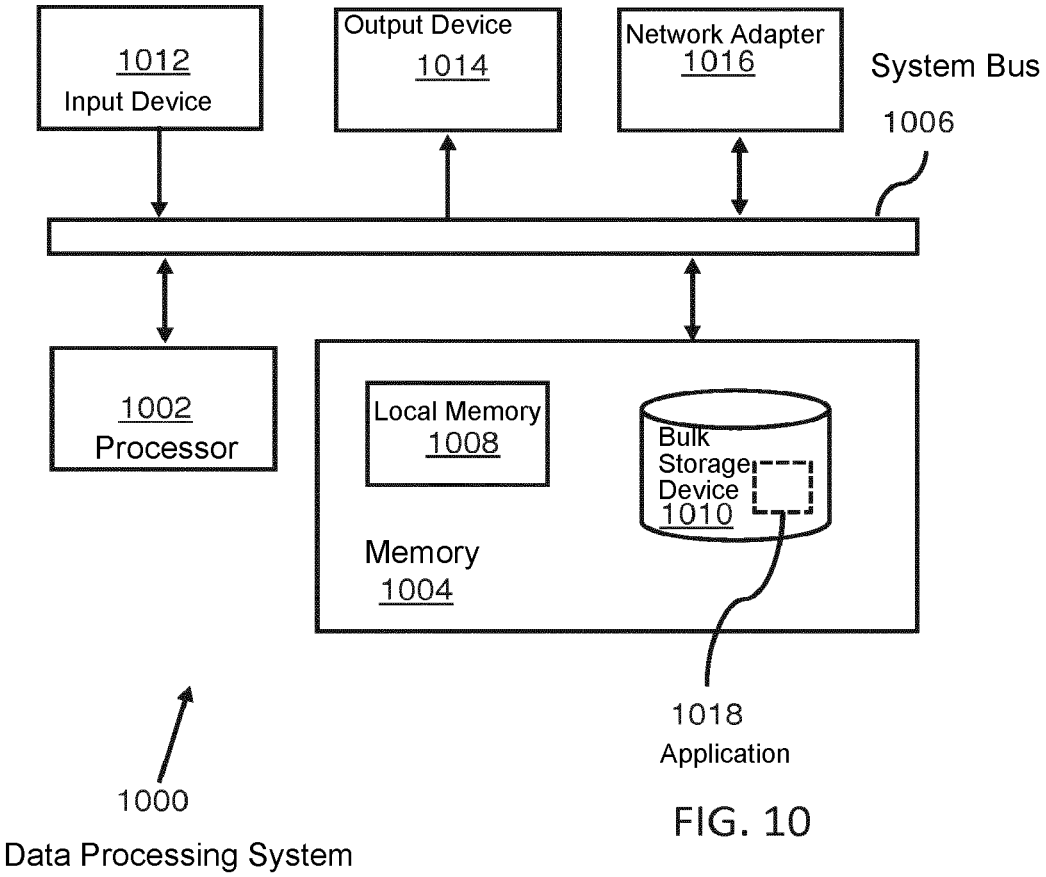
FIG. 10 shows a block diagram illustrating an exemplary data processing system.

FIG. 10 shows a block diagram illustrating an exemplary data processing system that may be used in the embodiments of this disclosure. Such data processing systems include data processing entities described in this disclosure, including but not limited to the remote-control device, the user device and the server. For example, the remote-control device may be implemented in a mobile phone having such a data processing system. Data processing system 1000 may include at least one processor 1002 coupled to memory elements 1004 through a system bus 1006. As such, the data processing system may store program code within memory elements 1004. Further, processor 1002 may execute the program code accessed from memory elements 1004 via system bus 1006. In one aspect, data processing system may be implemented as a computer that is suitable for storing and/or executing program code. It will be appreciated, however, that data processing system 1000 may be implemented in the form of any system including a processor and memory that is capable of performing the functions described within this specification.

Memory elements 1004 may include one or more physical memory devices such as, for example, local memory 1008 and one or more bulk storage devices 1010. Local memory may refer to random access memory or other non-persistent memory device(s) generally used during actual execution of the program code. A bulk storage device may be implemented as a hard drive, solid state disk or another persistent data storage device. The processing system 1000 may also include one or more cache memories (not shown) that provide temporary storage of at least some program code in order to reduce the number of times program code must be retrieved from bulk storage device 1010 during execution. Input/output (I/O) devices depicted as input device 1012 and output device 1014 may optionally be coupled to the data processing system. Examples of input devices may include, but are not limited to, for example, a microphone, a keyboard, a pointing device such as a mouse, a touchscreen or the like. Examples of output devices may include, but are not limited to, for example, a monitor or display, speakers, or the like. Input device and/or output device may be coupled to data processing system either directly or through intervening I/O controllers. A network adapter 1016 may also be coupled to, or be part of, the data processing system to enable it to become coupled to other systems, computer systems, remote network devices, and/or remote storage devices through intervening private or public networks. The network adapter may comprise a data receiver for receiving data that is transmitted by said systems, devices and/or networks to said data and a data transmitter for transmitting data to said systems, devices and/or networks. Modems, cable modems, and Ethernet cards are examples of different types of network adapter that may be used with data processing system 1000.

As shown in FIG. 10, memory elements 1004 may store an application 1018. It should be appreciated that the data processing system 1000 may further execute an operating system (not shown) that may facilitate execution of the application. The application, being implemented in the form of executable program code, may be executed by data processing system 1000, e.g., by the processor 1002. Responsive to executing the application, the data processing system may be configured to perform one or more operations to be described herein in further detail.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A remote device that controls a plurality of user devices, comprising:

an input element that receives input from a user, a transmitter that transmits control commands to the plurality of user devices for control thereof based on the input from the user, a directional optical sensor that receives each optical signal of a plurality of optical signals, wherein each optical signal of the plurality of optical signals corresponds to a user device of the plurality of user devices, wherein each of the plurality of optical signals comprises a signal pattern of signal parts to be sampled at a sampling rate of a receiver clock, wherein each of the signal patterns uniquely identifies a corresponding user device of the plurality of used devices, wherein each of the signal parts of each of the signal patterns comprises a low signal state during a low period and a high signal state during a high period, wherein each low period and each high period of each of the signal parts of each of the signal patterns comprise granulated lengths, wherein different granulated lengths determine different signal part types;

wherein each granulated length of each of the low and high periods of each of the signals parts of each of the signal patterns is an integer number of clock periods of a transmitter clock, wherein the transmitter clock has a clock ratio to the receiver clock, wherein the clock ratio is a number larger than one, and wherein at least one granulated length is longer than an integer number of clock periods of the receiver clock by a fraction of one clock period of the clock periods of the receiver clock; and a processor, wherein the processor decodes signal parts of a select optical signal, the select optical signal being one of the plurality of optical signals, based on detecting the granulated lengths and associating each signal part with its signal part type, from the select optical signal, for obtaining therefrom the signal pattern of the select optical signal, and wherein the processor identifies a particular user device of the plurality of user devices based on the signal pattern of the select optical signal.

2. The remote-control device of claim 1, wherein the different granulated lengths determining the different signal part types only comprise selected lengths corresponding to a sequence of non-consecutive numbers of clock periods of the receiver clock, and the processor provides error detection upon detecting a length corresponding to a number missing in the sequence.

3. The remote-control device of claim 1, wherein the processor decodes signal parts of the select optical signal having a range of expected values relative to a respective nominal length, wherein the range of expected values has two values for shortest high or low periods, and at least three values for at least one longer high or low period.

4. The remote-control device of claim 1, wherein the processor decodes the signal parts of the select optical signal by:

for each signal part of the select optical signal, detecting the granulated length of the high period, or by, for each signal part of the select optical signal, detecting the granulated length of the high period and separately detecting a granulated length of an adjacent low signal period; or by for each signal part of the select optical signal, detecting, in combination, the granulated length of the high period and detecting a granulated length of a preceding and/or following low signal period.

5. The remote-control device of claim 1, wherein the directional optical sensor detects an incoming direction or differences between incoming directions of each optical signal, wherein the select optical signal is based on a detected incoming direction of the select optical signal; or the directional optical sensor is arranged to receive multiple optical signals from multiple directions and the processor is arranged to obtain respective signal patterns in parallel and the select optical signal is based on a combination of incoming direction and the obtained signals patterns.

6. The remote-control device of claim 1, wherein, for accommodating the plurality of optical signals comprising respective signal patterns according to respective different code systems, each code system having a respective different sync signal part type representing a boundary of a data word, the processor detects a respective one of the code systems based on the respective sync signal part and subsequently to decode the signal parts of the select optical signal according to the respective one of the code systems.

7. A system comprising a remote-control device of claim 1, and the plurality of user devices.

8. A method of analyzing optical signals for identification of each user device of a plurality of user devices, in a remote-control device, the method comprising:

receiving, using a directional optical sensor, each optical signal of a plurality of optical signals corresponding to a user device of the plurality of user devices, detecting an incoming direction of each optical signal of the plurality of optical signals;

wherein each of the plurality of optical signals comprises high and low signal states constituting signal parts to be sampled at a sampling rate of a receiver clock, wherein each optical signal of the plurality of optical signals comprises a signal pattern of signal parts, wherein each of the signal patterns uniquely identifies a corresponding user device of the plurality of user devices; and wherein each of the signal parts of each of the signal patterns comprises at least one low signal state during a low period and at least one high signal state during a high period, wherein each low period and each high period of each of the signal parts of each of the signal patterns have granulated lengths, wherein different granulated lengths determine different signal part types;

wherein each granulated length of each of the low and high periods of each of the signals parts of each of the signal patterns is an integer number of clock periods of a transmitter clock, wherein the transmitter clock has a clock ratio to the receiver clock, wherein the clock ratio is a number larger than one, and wherein at least one granulated length is longer than an integer number of clock periods of the receiver clock by a fraction of one clock period of the clock periods of the receiver clock;

selecting a select optical signal of the plurality of optical signals, recognizing the signal parts of the select optical signal based on the granulated lengths of the low and high periods of the signal parts of the select optical signal, associating each signal part of the select optical signal with its signal part type to obtain therefrom the signal pattern of the select optical signal, identifying a particular user device of the one or more user devices based on the signal pattern of the select optical signal.

9. A non-transitory computer-readable medium comprising a computer program, the computer program comprising instructions for causing a processor system to perform the method according to claim 8.

10. A first user device that is operated by means of a remote-control device of claim 1, the first user device comprising:

a receiver that receives control commands from the remote-control device for control of the first user device, an optical transmitter, a modulator cooperating with the optical transmitter that modulates a first optical signal to have high and low signal states constituting signal parts to be sampled by the receiver clock, and a controller that controls the modulator to modulate the first optical signal in accordance with a signal pattern that uniquely identifies the first user device.

11. The first user device of claim 10, wherein each signal part of the modulated first optical signal consists of one leading or trailing low signal state during a low period and one high signal state during a high period, and different signal part types comprise 4 duo-bit types each representing different values of two bits of a data word and one sync type representing a boundary of the data word.

12. The first user device of claim 10, wherein the clock ratio is 2;

granulated lengths of low periods of the modulated first optical signal include 3 clock periods of the transmitter clock;

granulated lengths of high periods of the modulated first optical signal include 3,9,16 and 24 clock periods of the transmitter clock for a data signal part type; and the granulated lengths of the high periods of the modulated first optical signal include 33 clock periods of the transmitter clock for a sync signal part type representing a boundary of a data word.

13. The first user device of claim 10, wherein the clock ratio is 2;

granulated lengths of low periods of the modulated first optical signal include 3 and 7 clock periods of the transmitter clock;

granulated lengths of high periods of the modulated first optical signal include 3 and 7 clock periods of the transmitter clock for a data signal part type; and the granulated lengths of the high periods of the modulated first optical signal include 11 clock periods of the transmitter clock for a sync signal part type representing a boundary of a data word.

* * * * *